US005156367A

United States Patent [19]

Wolfe

[11] Patent Number: 5,156,367

[45] Date of Patent: Oct. 20, 1992

[54] SLIDABLE TRAY SUPPORT

[76] Inventor: Michael M. Wolfe, 29489 Via Los Colinas #233, Temecula, Calif. 92592

[21] Appl. No.: 657,391

[22] Filed: Feb. 19, 1991

[51] Int. Cl.[5] ..... A47F 5/00

[52] U.S. Cl. ..... 248/298; 108/93

[58] Field of Search ..... 248/298; 108/90, 93, 108/97, 102, 143

[56] References Cited

U.S. PATENT DOCUMENTS

| | | | |
|---|---|---|---|
| 2,333,516 | 11/1943 | Brusilowsky | 108/93 |
| 2,891,679 | 6/1959 | Maupin | 108/93 |
| 3,185,114 | 5/1965 | Consin . | |
| 3,908,562 | 9/1975 | Wittschen | 198/93 |
| 4,032,232 | 6/1977 | Perthes | 248/298 |

FOREIGN PATENT DOCUMENTS

| | | | |
|---|---|---|---|
| 216378 | 8/1941 | Switzerland | 108/93 |

*Primary Examiner*—David M. Purol

[57] ABSTRACT

A U-shaped rack slidably supported for movement between a retracted position located underneath a restaurant table and an extended position projecting outwardly beyond the edge of the table. The rack can be used to support a serving tray when a waiter is transferring dishes, plates, etc. from the tray to the table. The guide structure for the rack includes a channel attachable to the undersurface of the table and two plastic guide tubes extending through aligned holes in the channel flanges.

2 Claims, 1 Drawing Sheet

SLIDABLE TRAY SUPPORT

BACKGROUND AND SUMMARY OF THE INVENTION

This invention relates to a device for supporting a food serving tray in a location alongside a restaurant table. The invention is thought to be an improvement on a device shown in U.S. Pat. No. 3,185,114 issued to G. J. Consin.

U.S. Pat. No. 3,185,114 shows a rack device designed to form a horizontal platform for a serving tray in a restaurant. The rack device includes a U-shaped frame formed out of an aluminum tube. Tracks are attached to the underside of a restaurant table to normally support the frame in a retracted position underneath the table. The frame can be pulled out to a position extending alongside the table, after which a serving tray carrying dinners can be deposited on the frame. The waiter is then able to serve the meal, i.e. transfer the various plates, cups, glasses, etc. from the tray to the table.

The device shown in U.S. Pat. No. 3,185,114 includes two separate brackets for slidably supporting the U-shaped frame. Unless those brackets are very accurately aligned and spaced the U-shaped frame will tend to bind, i.e. not move smoothly between its retracted position and its extended position. This can be troublesome because the waiter will be able to use only one hand when he/she is moving the frame; one hand will be carrying the tray of food so that the waiter has to move the U-shaped frame in or out on the guide brackets with only one hand.

The problem of properly aligning and spacing the guide brackets is complicated by the fact that the frame has a relatively long stroke distance between its extended and retracted position, e.g. at least about twenty inches. The guide brackets can appear to be properly spaced and aligned when the frame is at or near its retracted position; however when it is attempted to move the frame to its other position the frame may bind in the guide brackets or dislocate one of the brackets from a correct position.

The device shown in U.S. Pat. No. 3,185,114 appears to be an all-metal construction. Both the guide brackets and the U-frame are formed of metal. When bare metal components slide on one another they tend to produce a grinding sound that can be quite disturbing or annoying. Use of the device disclosed in U.S. Pat. No. 3,185,114 in a restaurant might in many cases be annoying to restaurant patrons.

The present invention relates to a tray-supporting device that is in many respects similar to the device shown in U.S. Pat. No. 3,185,114. However, instead of two separate guide brackets I provide a guide structure comprised of a single channel having downwardly extending flanges, and two horizontal plastic guide tubes extending horizontally between the channel flanges. Parallel tubular sections of a U-shaped rack (frame) are slidably guided in the plastic tubes.

A principal advantage of my proposed tray-support device is that the entire device can be manufactured and aligned in a factory (prior to attachment of the device on the underside of a restaurant table). The channel includes a flat web wall having a number of holes therethrough. Mounting the device to the underside of a table merely involves screwing screws through the holes into the table, without any need for aligning or spacing one guide bracket relative to another guide bracket. The channel itself serves as the aligning device for the plastic guide tubes.

The contemplated tray support device is slidably guided (supported) in two plastic tubes. There is a metal-to-plastic (or plastic-to-plastic) slidable contact that can be essentially noiseless. In a restaurant atmosphere this would be of considerable importance.

THE DRAWINGS

DESCRIPTION OF A PREFERRED EMBODIMENT OF THE INVENTION

Figure 3:
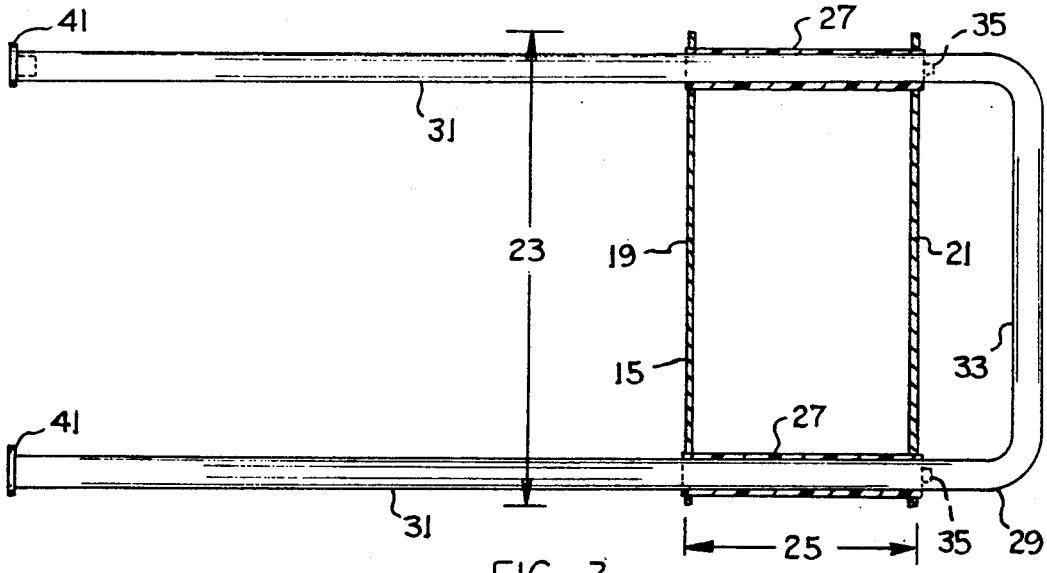
FIG. 3 is a sectional view taken on line 3—3 in FIG. 1.

There is shown a conventional restaurant table 11 having an edge 13. A metal channel 15 is attached to the undersurface of the table by screws 15. The channel comprises a web 17 and two parallel flanges 19 and 21. As shown in FIG. 3, the channel has a length dimension 23 greater than its transverse width dimension 25. Two plastic guide tubes 27 have end portions thereof extending through circular holes in flanges 19 and 21. An adhesive (not shown) may be used to secure the tubes to the channel flanges.

The plastic guide tubes will be assembled to the channel in a factory setting prior to attachment of the channel to table 11. Precision jigs and fixtures can be used to facilitate accurate alignment and spacing of the holes used to mount the plastic tubes on the channel. Each plastic tube has a length slightly greater than the width dimension of channel 15, such that end surfaces of the tubes form limit stops for a U-shaped rack (frame) 29.

Figure 1:
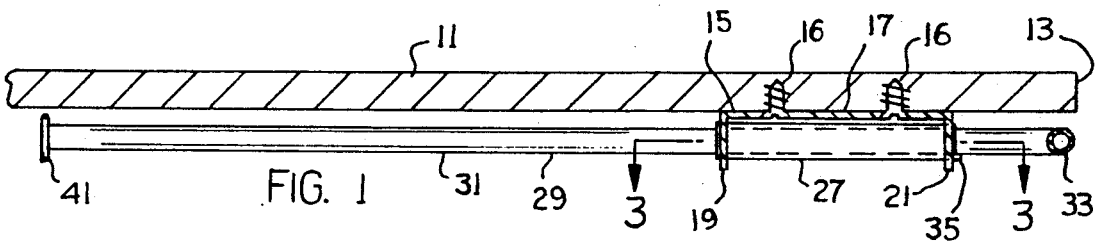
FIG. 1 is a sectional view taken through a device embodying features of the invention.

Frame 29 is formed out of a circular cross-sectioned tube into a U-configuration; the tube can be metal or plastic. Two tubular end sections 31 extend right angularly from a central handle section 33 for slidable disposition in plastic tubes 27 FIG. 1 shows rack 29 in a retracted position; abutments 35 project downwardly from tubular end sections 31 to engage the ends of tubes 27, thereby preventing the rack from moving too far underneath the table. Handle section 33 is located below the edge area of the table away from the nearest channel flange 21, such that the person can readily grasp the handle section.

Figure 2:
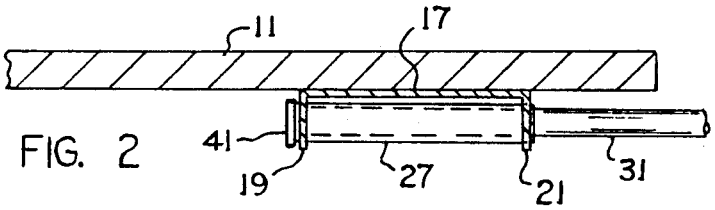
FIG. 2 is a view taken in the same direction as FIG. 1, but showing the device in a different condition of adjustment.

The U-shaped rack can be pulled rightwardly to an extended position wherein handle section 33 is spaced away from the table surface. When the rack is in its extended position caps 41 on the left ends of tubular sections 31 engage the left ends of plastic tubes 27 to limit rightward movement of the rack. The stroke of the rack between its FIG. 1 and FIG. 2 positions is about twenty inches. When the rack is in its FIG. 2 position it can be used to support a food serving tray (not shown).

A principal feature of the invention is the unitary construction of channel 15 and plastic guide tubes, whereby the entire rack can be attached to the table without having to adjust or space the guide tubes. Rack 29 will be mounted on (in) tubes 27 prior to the time when the device is attached to the table.

I claim:

1. A device for supporting a food serving tray alongside a restaurant table; said device comprising a channel having a web and two parallel flanges extending right angularly from said web; said channel having a longitudinal axis extending parallel to said flanges and a transverse axis extending normal to said flanges; two sets of aligned circular holes extending through the flanges parallel to the transverse axis; two parallel plastic tubes extending between said flanges, with opposite ends thereof seated in said circular holes; each tube having a circular cross-section; said channel being adapted for disposition beneath a restaurant table, with said web being facially engaged against the table undersurface and with the flanges extending parallel to an edge of the table; a U-shaped rack formed out of a circular cross sectioned tube; said U-shaped rack comprising a central tubular handle section extending parallel to said channel flanges, and two tubular tray support end sections extending right angularly from said central handle section; said tubular end sections being slidably positioned within said plastic tubes, whereby the rack can be moved between a retracted position wherein the central handle section is located directly below an edge area of the table and an extended position wherein said handle section is spaced outwardly away from the table edge.

2. The device of claim 1, wherein the opposite ends of the plastic tubes extend beyond the channel flanges so that the end surfaces of the tubes form limit stops for the rack; said tubular end sections having abutments projecting downwardly therefrom for engagement with end surfaces of the plastic tubes so that when the rack is in its retracted position the handle section of the rack is spaced away from the nearest channel flange.

* * * * *